US007484994B2

(12) United States Patent
Ko

(10) Patent No.: US 7,484,994 B2
(45) Date of Patent: Feb. 3, 2009

(54) CABLE CONNECTOR ASSEMBLY

(75) Inventor: David Tso-Chin Ko, Cypress, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/074,297

(22) Filed: Mar. 3, 2008

(65) Prior Publication Data

US 2008/0214043 A1 Sep. 4, 2008

(51) Int. Cl.
*H01R 12/24* (2006.01)

(52) U.S. Cl. ..... 439/495; 439/686

(58) Field of Classification Search ..... 439/492, 439/495, 496, 498, 499, 660, 686, 695
See application file for complete search history.

(56) References Cited

U.S. PATENT DOCUMENTS 3,144,288 A * 8/1964 Grant ..... 439/496
4,563,810 A * 1/1986 Adlon et al. ..... 29/749
5,980,303 A * 11/1999 Lee et al. ..... 439/405
6,702,607 B2 * 3/2004 Kondo ..... 439/498
6,832,934 B1 * 12/2004 Zhang ..... 439/660
6,951,476 B1 10/2005 Saito et al.
2006/0234542 A1 * 10/2006 Ko ..... 439/495
2007/0082555 A1 * 4/2007 Tanaka ..... 439/660

* cited by examiner

*Primary Examiner*—James Harvey
(74) *Attorney, Agent, or Firm*—Wei Te Chung

(57) ABSTRACT

A cable connector assembly (100) includes an insulated housing (1) having a mating portion (12) and a base portion (13) extending rearward from back surface of the mating portion; a number of terminals (2) received in the mating portion; a retaining member (3) having depression portions on both upper and lower surfaces thereof; a first flat cable and a second flat cable (41, 42) with partial of front portions thereof respectively attached to the depression portions of the retaining member and retained therein via securing means and further electrically connecting with the terminals; and a holding member (5) coupled to the insulated housing to prevent the retaining member disengaging from the insulated housing.

20 Claims, 7 Drawing Sheets

CABLE CONNECTOR ASSEMBLY

BACKGROUND OF THE INVENTION

1. Field of the Invention

The present invention generally relates to a cable connector assembly, and more particularly to a cable connector assembly adapted for a flat cable, and is an improvement of U.S. Pat. No. 7,275,955.

2. Description of Related Art

Flat type cables such as flexible flat cables ("FFC") and flexible printed cables ("FPC") are widely used in electric and electronic appliances and more specifically in computers, computer peripherals and computer devices and they are connected to such appliances via electrical connectors. U.S. Pat. No. 6,951,476 B1 discloses an electrical connector for a flat type cable that has a stiff backup element at one end portion thereof. The electrical connector includes an insulating housing having a cavity for receiving the end portion of the flat cable, a retaining member formed with a retainer block which has flat surfaces and is inserted in the cavity of the insulating housing, and a holding member engaging with the retaining member and further having connecting arms that connect the holding member to the insulating housing with the retaining member disposed between. Thus, the end portion of the flat cable formed a crank shape inside the connector and the stiff backup element unbendable inside the connector prevents the cable from being pulled out of the electrical connector. This kind of electrical connector is unique and easily assembled to the flexible flat cable. However, as the additional stiff backup element is required for the flexible flat cable, extra work is needed and the manufacturing costs may increase, thus a product price may increase.

Hence, an improved cable connector assembly is highly desired to overcome the aforementioned problems.

SUMMARY OF THE INVENTION

Accordingly, an object of the present invention is to provide a lower cost and easily manufactured cable connector assembly.

In order to achieve the object set forth, a cable connector assembly in accordance with the present invention comprises an insulated housing having a mating portion and a base portion extending rearward from back surface of the mating portion; a plurality of terminals received in the mating portion; a retaining member having depression portions on both upper and lower surfaces thereof; a first flat cable and a second flat cable with partial of front portions thereof respectively attached to the depression portions of the retaining member and retained therein via securing means, and further electrically connecting with the terminals; and a holding member coupled to the insulated housing to prevent the retaining member disengaging from the insulated housing.

Other objects, advantages and novel features of the invention will become more apparent from the following detailed description when taken in conjunction with the accompanying drawings.

DETAILED DESCRIPTION OF THE INVENTION

Figure 1:
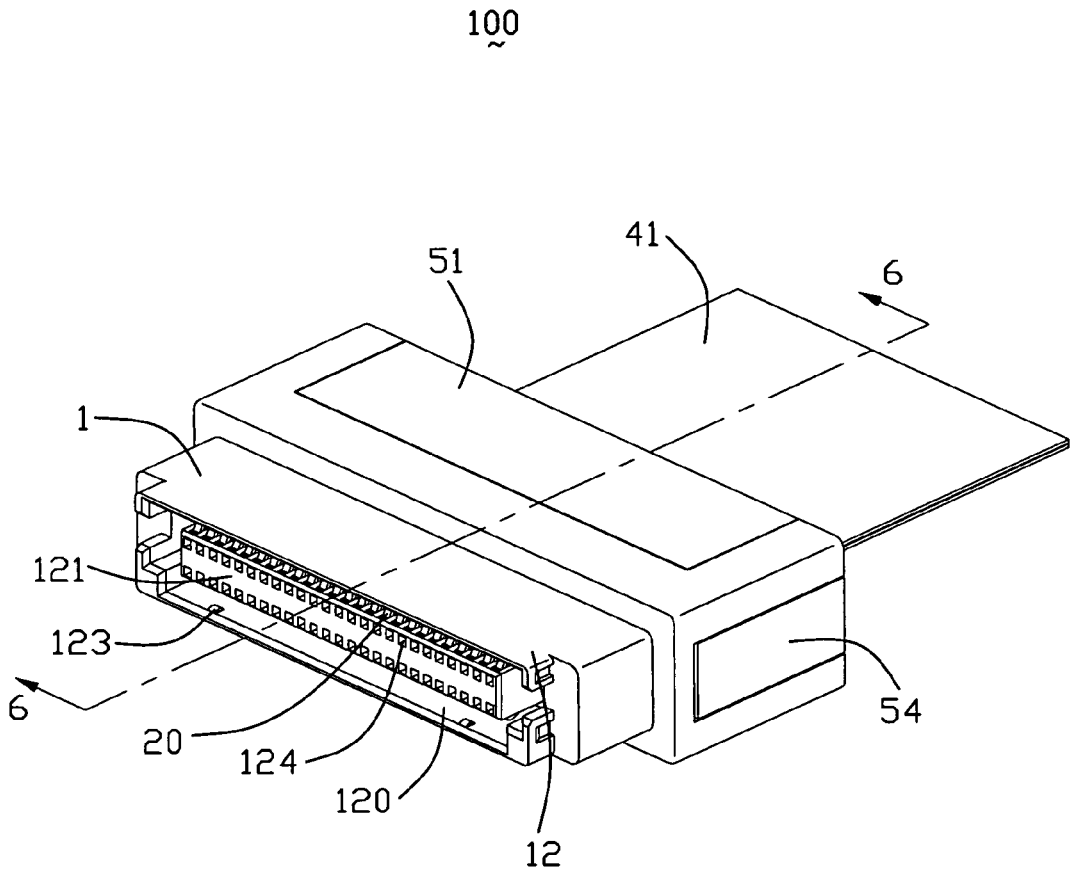
FIG. 1 is an assembled, perspective view of a cable connector assembly in accordance with the present invention.
Figure 2:
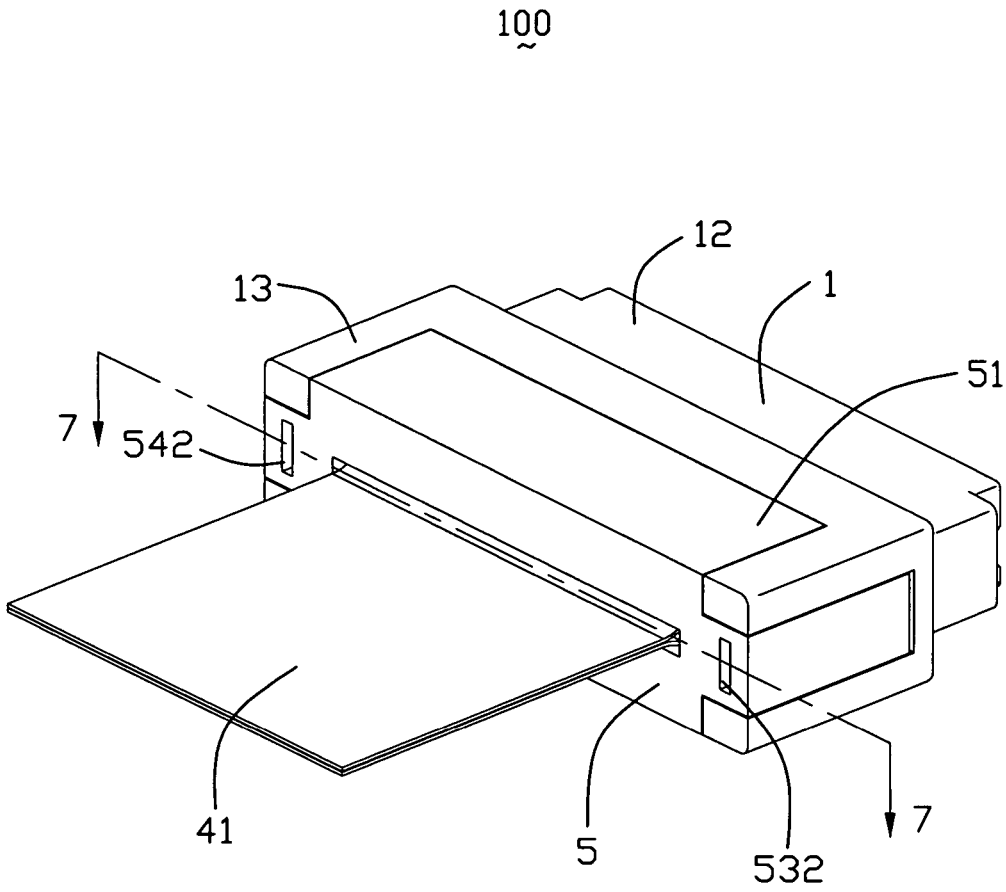
FIG. 2 is similar to FIG. 1, but viewed from another aspect.

Reference will now be made in detail to the preferred embodiment of the present invention.

Referring to FIGS. 1-5, a cable connector assembly 100 in accordance with the present invention comprises an insulated housing 1, a plurality of terminals 2 received in the insulated housing 1, a flat cable 4 partially attached to a retaining member 3 and together assembled to the insulated housing 1 to achieve electrical connection between the terminals 2 and the flat cable 4, and a holding member 5 coupled to the insulated housing 1 to securely keep the retaining member 3 therebetween.

Figure 3:
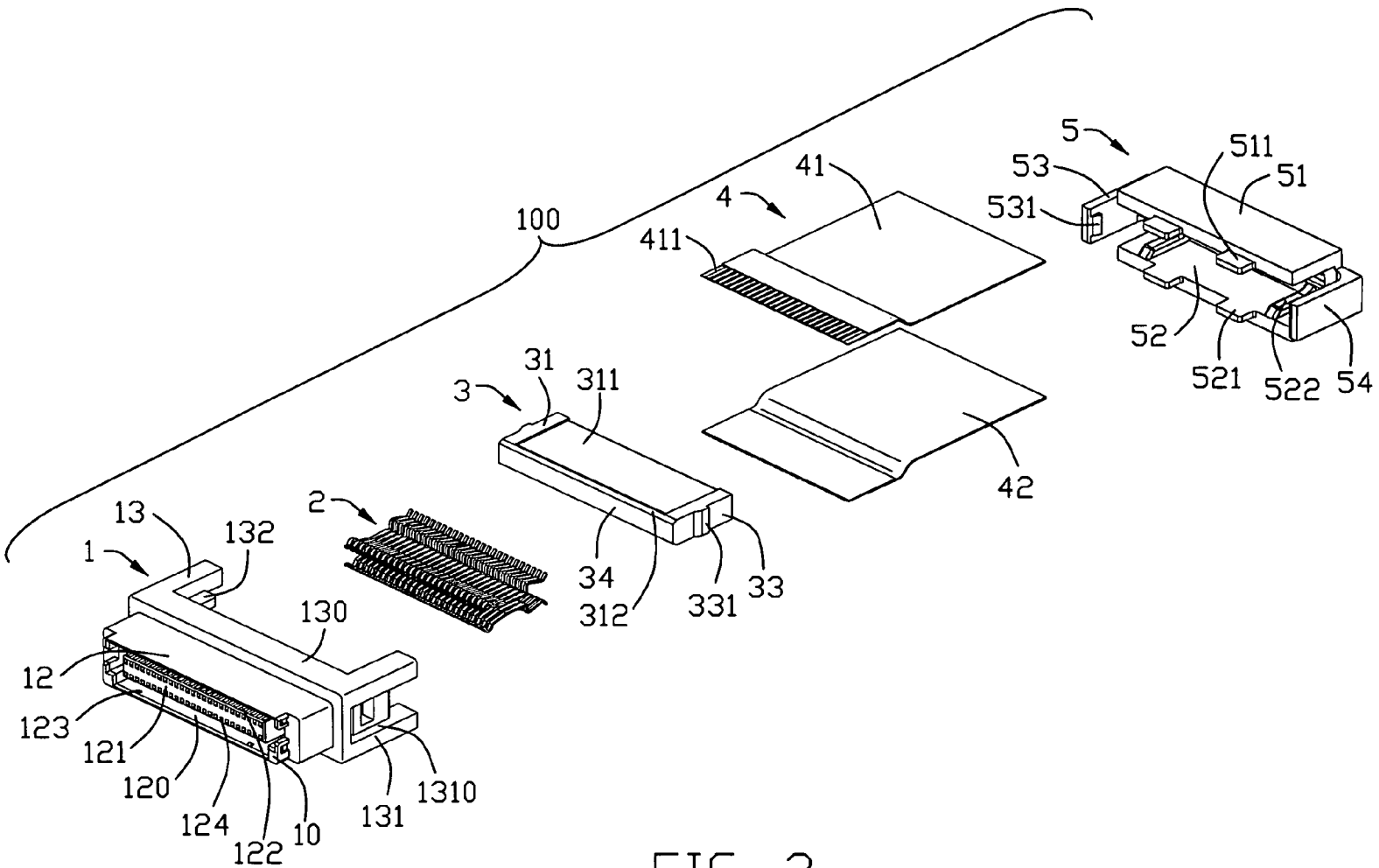
FIG. 3 is an exploded, perspective view of the cable connector assembly in accordance with the present invention.
Figure 4:
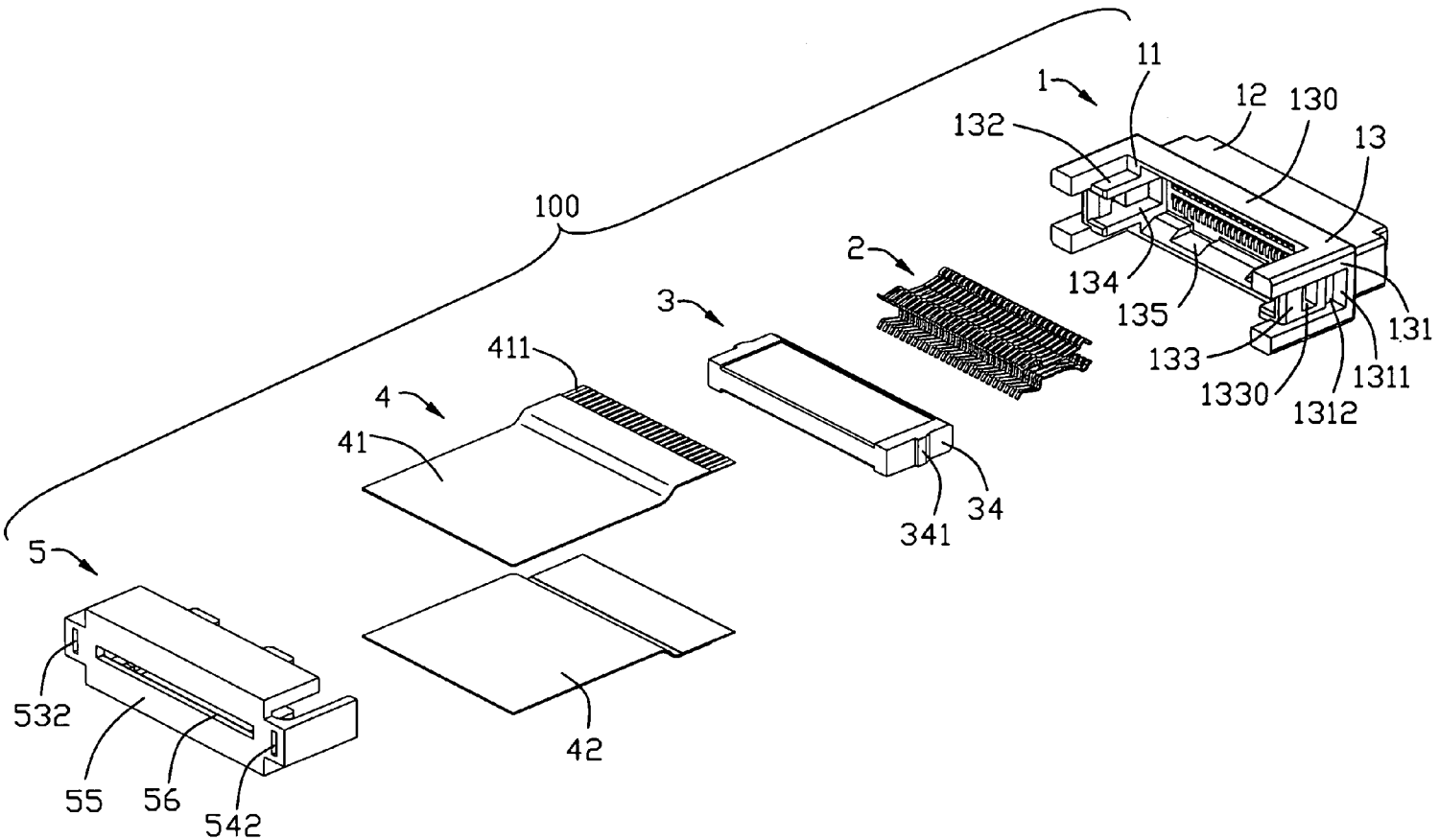
FIG. 4 is similar to FIG. 3, but viewed from another aspect.
Figure 5:
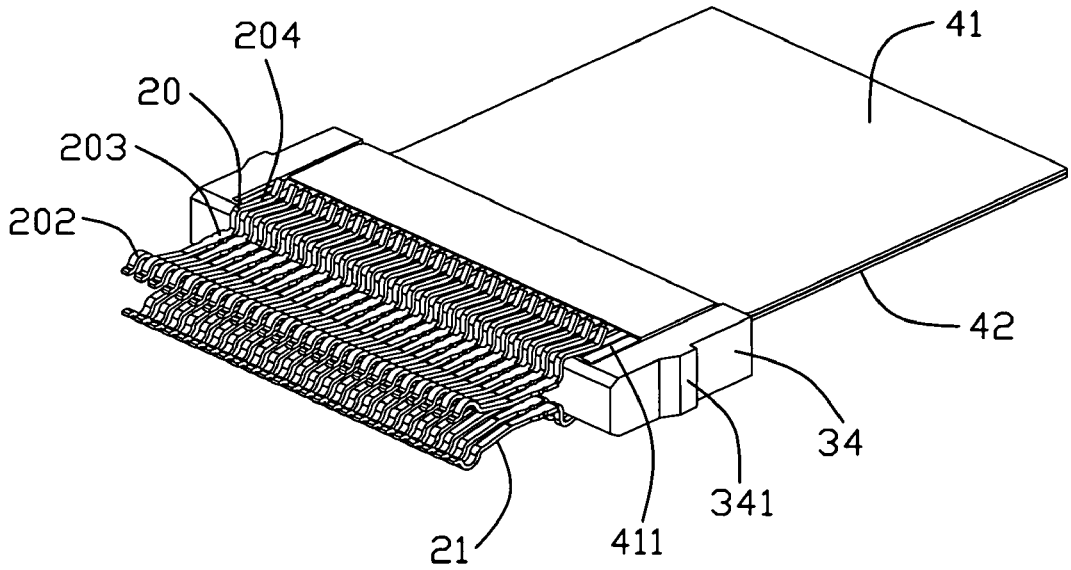
FIG. 5 is a view of a connecting relationship among terminals, a retaining member and a flat cable.
Figure 6:
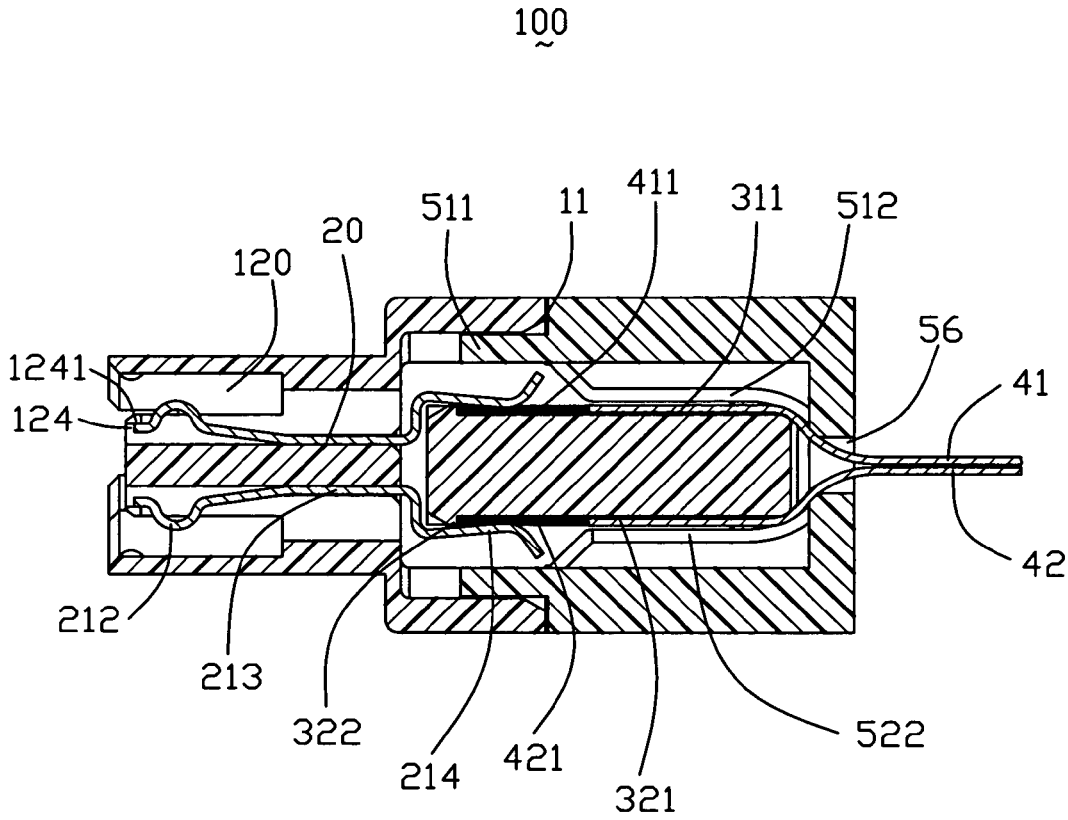
FIG. 6 is a cross-section view of FIG. 1 taken along line 6-6.

Referring to FIGS. 3-4, the insulated housing 1 includes a rectangular-shaped mating portion 12 with a front face 10 and a substantially U-shaped base portion 13 extending rearward from a back face (not numbered) opposite to the front face 10 of the mating portion 12. The mating portion 12 has a hollow portion 120 recessed rearward from the front face 10 and a tongue portion 121 arranged in a middle section of the hollow portion 120. The mating portion 12 forms two pair of protruding portions 123 respectively arranged on interior surface of a forward section of up and a low sides (not numbered) thereof for guiding a complementary connector (not shown) properly matching with the cable connector assembly 100. Both an upper surface and a lower surface of the tongue portion 121 define a plurality of terminal passages 122 arranged in a row along longitudinal direction and each of the terminal passages 122 has a front hole 124 communicating with outside. The base portion 13 comprises a rectangular-shaped frame portion 130 connecting to the back face of the mating portion 12 and a pair of arm portions 131 respectively extending rearward from lateral sides of the frame portion 130. The frame portion 130 defines two positioning slots 135 on inside surfaces of an top wall and a bottom wall (not numbered) thereof, respectively. Each arm portion 131 defines a U-shaped passage 1310 opening toward outside with a rear opening (not shown). A pair of guiding members 134 are respectively coupled to inward surfaces of the pair of arm portions 131. Each guiding member 134 includes a pair of upper and lower planar walls 132 parallel to each other and a vertical wall 133 interconnecting with the pair of planar walls 132 to form a passage way (not numbered) therebetween. Each vertical wall 133 defines a slot 1330 in a middle section thereof and communicating with the passage way of the guiding member 134 and the U-shaped passage 1330. Each vertical wall 133 further defines a depression portion 1312 on an outward surface of an end portion of thereof.

Referring to FIGS. 3-6, the retaining member 3 is a cuboids body which has a top surface 31, a bottom surface (not numbered) opposite to the top surface 31, and a pair of side surfaces 33, 34. Both the top surface 31 and the bottom surface (not numbered) have rectangular-shaped depression portions 311, 321 (FIG. 6) aligning with one another along vertical direction. A pair of flange portions 312, 322 are respectively formed in front sections of the depression portions 311, 321. A pair of stubs 331, 341 with wedge-shaped front faces are respectively arranged on middle parts of the pair of side surfaces 33, 34.

The terminals 2 with identical configuration are separated into a first set of terminals 20 and a second set of terminals 21. Each of the first set of terminals 20 and second set of terminals 21 include body portions 203, 213, arched contacting portions 202, 212 formed forward of the body portions 203, 213 and tail portions 204, 214 extending rearward from end sections of the body portions 203, 213 and biasing toward each other.

The flat cable 4 includes a first flat cable 41 and a second flat cable 42 combined together to form a two-layered cable component. Either the first flat cable 41 or the second flat cable 42 has a number of conductors 411, 421 enclosed by an insulated jacket (not numbered). The conductors 411, 421 are aligned in a row along transversal direction and extend along longitudinal direction.

Figure 7:
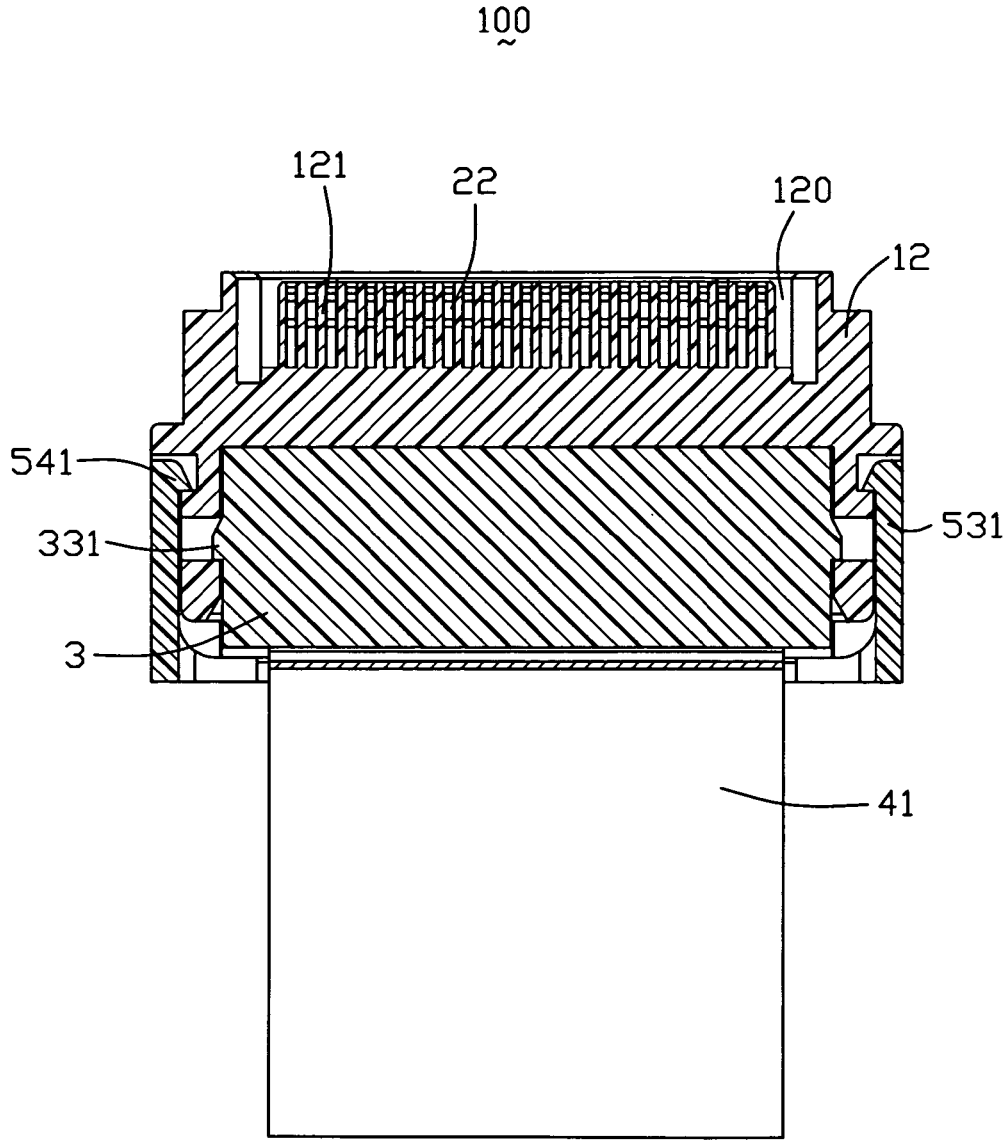
FIG. 7 is a cross-section view of FIG. 2 taken along line 7-7.

Referring to FIGS. 3, 4 and 7, the holding member 5 comprises a top wall 51, a bottom wall 52 and a back wall 55 connecting with the top and the bottom walls 51, 52 to form a substantially U-shaped hollow portion (not numbered). Both the top wall 51 and the bottom wall 52 have a pair of spaced protrusion portions 511, 521 extending forward from front edges thereof. A pair of ribs 512, 522 are respectively located on two opposite sides of the inner surfaces of the top wall 51 and bottom wall 52. A pair of L-shaped latching members 53, 54 are located at opposite sides of the U-shaped hollow portion and the latching members 53, 54 further have locking tabs 531, 541 formed at forward sections thereof. The back wall 55 defines a slit 56 communicating with the hollow portion and the pair of L-shaped latching members 53, 54 respectively defines through holes 532, 542 at rear section thereof.

When assembly, firstly, the first set of terminals 20 and the second set of terminals 21 are respectively assembled to the insulated housing 1, with the body portions 203, 213 received in the terminal passages 122 of the tongue portion 121, the contacting portions 202, 212 springing into the hollow portion 120 and the tail portions 204, 214 disposed outside of a rear surface of the insulated housing 1. Secondly, partial insulated jackets of the front sections of the first flat cable 41 and the second flat cable 42 are peeled off and the conductors 411, 422 are exposed outside, then glue or other adhesive materials is applied to the depression portions 311, 322 of the retaining member 3, and then the first flat cable 41 and the second flat cable 42 are disposed in the depression portions 311, 322 and fixed thereon. Thirdly, the retaining member 3 slides along passage ways of the guiding members 134 till the stubs 331, 341 locking into the slots 1330 of the vertical walls 133, simultaneously, the tail portions 204, 214 of terminals 2 press on the conductors 411, 421 of the first and the second flat cables 41, 42 to achieve better electrical connection therebetween. Fourthly, the flat cable 4 is drawn outward through the slit 56 of the back wall 55 of the holding member 5. Fifthly, the holding member 5 is assembled to the insulated housing 1, with the guiding members 134 received in the U-shaped hollow portion (not numbered) of the holding member 5, the protrusion portions 511, 521 inserted into the positioning slots 135 of the frame portion 130, the pair of latching members 53, 54 sliderably received in the U-shaped passages of the pair of arm portions 131 respectively, with their forward locking tabs 531, 541 latching into the depression portions 1312 of the vertical wall 133. The ribs 512, 522 of the holding member 5 together with retaining member 3 are adapted for sandwiching the first flat cable 41 and the second flat cable 42, thus the first flat cable 41 and the second flat cable 42 can't move freely.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

an insulated housing including a mating portion and a base portion extending rearward from a back surface of the mating portion;

a plurality of terminals received in the mating portion;

a retaining member having depression portions on both upper and lower surfaces thereof;

a first flat cable and a second flat cable with partial of front portions thereof respectively attached to the depression portions of the retaining member and retained therein via securing means, and further electrically connecting with the terminals; and a holding member coupled to the insulated housing to prevent the retaining member from disengaging from the insulated housing.

2. The cable connector assembly as claimed in claim 1, wherein the mating portion defines a hollow portion with a tongue portion located therein.

3. The cable connector assembly as claimed in claim 2, wherein each of the terminals includes a body portion received in corresponding terminal passages of the tongue portion, an arched contacting portion formed forward of the body portion and extending into the hollow portion, a tail portion extending rearward from an end section of the body portion and further press on the first or the second flat cable.

4. The cable connector assembly as claimed in claim 1, wherein the retaining member latchably engages with the insulated housing, wherein the retaining member is accommodated in the holding member.

5. The cable connector assembly as claimed in claim 4, wherein base portion has a pair of guider members located at opposite lateral sides thereof and extending rearward therefrom; wherein the retaining member is assembled to the insulated housing via the guiding members.

6. The cable connector assembly as claimed in claim 5, wherein each guiding member includes a pair of upper and lower planar walls parallel to each other and a vertical wall interconnecting with the pair of upper and lower planar portions to form a passage way therebetween, wherein each vertical wall of the guiding member defines a slot communicating with the passage way of the guiding member, and wherein the retaining member defines a pair of stubs respectively arranged on side surfaces thereof and further locking into the slots of the guider member respectively.

7. The cable connector assembly as claimed in claim 1, wherein the base portion comprises a rectangular-shaped frame portion connecting to a back face of the mating portion and a pair of arm portions respectively extending rearward from two lateral sides of the frame portion.

8. The cable connector assembly as claimed in claim 7, wherein each of the pair of the arm portions defines a substantially U-shaped passage opening toward outward with a rear opening, wherein the base portion further defines a pair of depression portions adjacent to end sections of the U-shaped passages respectively.

9. The cable connector assembly as claimed in claim 8, wherein the holding member comprises a top wall, a bottom wall and a back wall connecting with the top and the bottom walls to enclose a substantially U-shaped hollow portion therebetween to receiving the retaining member.

10. The cable connector assembly as claimed in claim 9, wherein the holding member further has a pair of latching members located at opposite sides of the U-shaped hollow, wherein the pair of latching arms are received in the pair of U-shaped passages of the pair of arm portions, and wherein the pair of latching members further have locking tabs lock into the depression portions adjacent to end sections of the U-shaped passages, respectively.

11. The cable connector assembly as claimed in claim 9, wherein the back wall of the holding member defines a slit therein to allow the first and the second flat cables extending outside therein.

12. A cable connector assembly comprising:

an insulated housing including a mating portion defining a hollow portion with a forward opening and a base portion extending rearward from back surface of the mating portion;

a plurality of terminals received in the insulated housing;

wherein the base portion has a frame portion connecting to the back face of the mating portion;

wherein the base portion further has a pair of arm portions respectively extending rearward from two lateral sides of the frame portion and each of the arm portions defines a U-shaped Passage;

and wherein the base portion further has a pair of guiding portions respectively attached to inward surfaces of the pair of arm portions and the guiding member has a passage way along a mating direction;

a retaining member having a depression portion on either both upper or lower surfaces thereof and being partially received in the passage ways of the guiding members; and a flat cable with partial of the front portion thereof disposed on the depression portion and retained therein via securing means; and a holding member coupled to the insulated housing to prevent the retaining member from moving away from the insulated housing, said holding member having a pair of latching members sliderably received in the U-shaped passages of the pair of arm portions respectively and latching with the insulated housing.

13. The cable connector assembly as claimed in claim 12, wherein each guiding member includes a pair of upper and lower planar walls parallel to each other and a vertical wall interconnecting with the pair of upper and lower planar portions to form the passage way therebetween, and wherein outward surfaces of end sections of the vertical walls respectively defines a depression portion thereof.

14. The cable connector assembly as claimed in claim 13, wherein each of the pair of latching members is configured to L-shaped and arranged lateral sides of the holding member, and wherein the latching member forms a locking tab at forward end portion thereof and locks into the depression portion of the vertical wall of the guiding member.

15. The cable connector assembly as claimed in claim 12, wherein the frame portion has an top wall and a bottom wall which respectively defines two positioning slots on corresponding inner surfaces thereof.

16. The cable connector assembly as claimed in claim 15, wherein the holding member comprises a top side, a bottom side and a back side connecting with the top and the bottom sides to enclose a substantially U-shaped hollow portion, wherein front edges of the top side and the bottom side respectively forms a pair of spaced protrusion portions received in the positioning slots of the frame portion.

17. The cable connector assembly as claimed in claim 16, wherein the top wall and the bottom wall respectively form a pair of ribs located on two opposite sides of the inner surfaces thereof, and wherein partial of the flat cable sandwiched between the ribs and the retaining member.

18. A cable connector assembly comprising:

an insulated housing including a front mating portion and a rear base portion;

a plurality of terminals each having a mating section disposed on the mating portion and tail section located in the base portion;

a retaining member received in the base portion and having at least one depression portion on at least one surface thereof;

at least one flat flexible cable with thereof a front portion snugly retainably received in the depression portion with thereon conductors electrically connecting with the corresponding terminals, respectively; and a holding member coupled to the insulated housing to prevent the retaining member from disengaging from the insulated housing.

19. The cable connector assembly as claimed in claim 18, wherein the tail sections of the terminals cooperate with the retaining member to sandwich the flat flexible cable therebetween.

20. The cable connector assembly as claimed in claim 19, where said terminals are arranged with two rows, and said retaining member further defines another depression portion to receive another flat flexible cable so that said two rows of terminals cooperate with the retaining member to respectively sandwich said flat flexible cable and said another flat flexible cable.

* * * * *